US011337885B1

(12) United States Patent
Conley

(10) Patent No.: US 11,337,885 B1
(45) Date of Patent: May 24, 2022

(54) HANDLED SOFT TISSUE MOBILIZATION DEVICES AND METHODS FOR MAKING SAME

(71) Applicant: Eric Conley, York, ME (US)

(72) Inventor: Eric Conley, York, ME (US)

( * ) Notice: Subject to any disclaimer, the term of this patent is extended or adjusted under 35 U.S.C. 154(b) by 789 days.

(21) Appl. No.: 16/118,355

(22) Filed: Aug. 30, 2018

(51) Int. Cl.
*A61H 7/00* (2006.01)
*A61H 15/00* (2006.01)

(52) U.S. Cl.
CPC ..... *A61H 7/003* (2013.01); *A61H 7/007* (2013.01); *A61H 15/0092* (2013.01); *A61H 2201/0153* (2013.01); *A61H 2201/0157* (2013.01); *A61H 2201/1253* (2013.01); *A61H 2205/081* (2013.01); *A61H 2205/10* (2013.01)

(58) Field of Classification Search
CPC .... A61H 7/003; A61H 7/007; A61H 15/0092; A61H 2205/081; A61H 2205/10
See application file for complete search history.

(56) References Cited

U.S. PATENT DOCUMENTS 412,479 A * 10/1889 Davis ..... A63B 60/08 264/271.1
2,205,769 A * 6/1940 Sweetland ..... A63B 60/12 81/492
4,483,328 A * 11/1984 Wolocko ..... A61H 1/008 601/135
5,155,878 A * 10/1992 Dellis ..... B62K 21/26 16/421
5,231,977 A * 8/1993 Graston ..... A61H 7/003 601/34
5,441,478 A * 8/1995 Graston ..... A61H 7/003 601/135
5,707,346 A * 1/1998 Graston ..... A61H 7/003 601/135
6,077,239 A * 6/2000 Lin ..... A61H 7/003 601/134
6,176,841 B1 * 1/2001 Tso ..... A61H 15/0092 601/129
6,254,555 B1 * 7/2001 Sevier ..... A61H 7/001 601/134
6,887,211 B1 * 5/2005 Sevier ..... A61H 7/001 601/135
8,801,642 B1 * 8/2014 Slominski ..... A61H 7/001 601/135
10,758,445 B2 * 9/2020 Fiore ..... A61H 7/003
2005/0159689 A1 * 7/2005 Olson ..... A61H 7/001 601/135
2006/0010630 A1 * 1/2006 Tse ..... A47K 7/02 15/160
2006/0293619 A1 * 12/2006 Louis ..... A61H 7/001 601/135
2007/0191745 A1 * 8/2007 Tucker ..... A61H 7/00 601/135

(Continued)

*Primary Examiner* — Tu A Vo
(74) *Attorney, Agent, or Firm* — Kajane McManus; Jeanette M Braun; John J Mariane

(57) ABSTRACT

A soft tissue mobilization device having a hand-held portion coated with a compressible material to take the strain off the hand of the user when using the device. The hand-held portion is coated with a compressible material to take a strain off the hand of the user, is custom molded to the user's hand, and the compressible material is a compound comprising a mixture of one or more low melting point polymers.

2 Claims, 3 Drawing Sheets

(56) References Cited

U.S. PATENT DOCUMENTS

| | | | | |
|---|---|---|---|---|
| 2009/0007387 | A1* | 1/2009 | Laghi | A63B 60/08 16/421 |
| 2013/0310234 | A1* | 11/2013 | Miller, Jr. | A63B 22/20 482/139 |
| 2014/0005581 | A1* | 1/2014 | Scappaticci | A61H 7/001 601/138 |
| 2014/0165787 | A1* | 6/2014 | Lombardi | B25G 1/02 81/22 |
| 2015/0068366 | A1* | 3/2015 | Lombardi | B25D 1/00 81/20 |
| 2016/0166459 | A1* | 6/2016 | Ghosh | A61H 7/001 601/137 |
| 2016/0374488 | A1* | 12/2016 | Shapiro | B29C 45/02 30/165 |
| 2017/0065480 | A1* | 3/2017 | Howson | A61H 7/001 |
| 2017/0120490 | A1* | 5/2017 | Shapiro | A47J 43/283 |

* cited by examiner

HANDLED SOFT TISSUE MOBILIZATION DEVICES AND METHODS FOR MAKING SAME

TECHNICAL FIELD

The present disclosure relates generally to methods and apparatuses related to practicing soft tissue massage, including a small plurality of a plethora of embodiments of devices for engaging the skin of an area to be massaged and being provided with a coated hand-held portion for relieving strain on the user's hand. The devices can provide a plurality of curvilinear surfaces of different radii and have a plurality of beveled treatment edges for contacting skin surfaces, and a plurality of compositions for coating the hand-held portion.

BACKGROUND OF THE INVENTION

Devices for use in instrument assisted soft tissue mobilization allow a practitioner or user to better apply forces to soft tissue and fascia of a patient and are known in the art. Each of the instruments may also comprise a plurality of curvilinear edge surfaces having different radii for contacting the skin in one or more locations.

The devices allow the practitioner or user to apply force to separate layers of tissue. They also allow the practitioner or user to help a patient's body break down scar tissue and adhesions as well as stretch tissues that have become tense or cramped. This is particularly helpful when a patient has had a soft tissue injury during sports or after surgery. This type of manipulation has been used for many years and has been applied in different areas including massage therapy, traditional Chinese GauSha which lifts and separates tissues of the patient allowing, in such traditional therapy, the chi to flow and for toxins to be released from the body. In a more recent western application this therapy has been used to assist a patient in healing after injury.

The challenge with the devices available currently, and also historically, is that they are designed to help heal the body of the patient but they hurt the body of the practitioner or user. The current devices are typically thin, made of highly polished stainless steel, titanium, bone, or stone, and have a periphery comprising one or more of rounded edges, flat edges and curves. The practitioner grips the device using primarily the small muscles on the inside of the palm of the hand and the constant force necessary to use the tool on the patient fatigues and/or strains those small muscles, which can cause carpal tunnel and other issues to other structures such as the tendons, ligaments, and connective tissue inside the practitioner's or user's hand. The thinness of the devices requires the user to grip the device as firmly as possible with muscles of the thumb as well.

Stress, strain, and the constant loading of the small muscles and tendons in the hand can cause chronic problems for practitioners and users. It is well known that the primary problem reported by people who drop out of the massage trade, including massage therapists, physical therapists, and athletic trainers, is due to the pain, discomfort, damage, and chronic degradation of their hands and forearms.

A device is needed, therefore, which can reduce the stress, strain, and load on the small muscles, tendons, ligaments, and connective tissue of the practitioner's or user's hand and forearm.

SUMMARY

Some exemplary devices disclosed herein deal with this issue by providing a larger surface for the hand to wrap around. The larger surface provides the user an ergonomic gripping area. The user can grip the device with four fingers and use very light pressure from the thumb to keep the device in position while still applying the force necessary to mobilize the soft tissue of the patient. The larger surface of the grip or hand-held portion aids in transferring the load or strain from the small muscles in the thumb to the large muscles in the larger, stronger forearm. This can decrease the amount of fatigue and stress that is placed upon the hand of the practitioner as a device is being used.

In another embodiment, the present disclosure provides for at least maintaining the resonance of the device. Resonance of the device is defined as what the practitioner or user feels through the device when pressing it against the patient. The practitioner or user can feel tissue bumps, friction, and changes in smoothness of motion resonating through the device which identify areas of adherence, scar tissue, and other injuries under the patient's skin. The soft and sensitive portions of the practitioner's or user's fingers are placed against the harder material of the device as it is scraped or passed over the injured area. Once the injured area is identified, the practitioner or user can apply the right amount of force to treat those areas.

The present disclosure provides an ergonomic gripping area to reduce the strain on the practitioner's or user's fingers while maintaining the sensitivity of the fingers so the resonance can be felt.

In one embodiment, the present disclosure provides for a soft tissue mobilization device comprising a skin contacting member having a first end, a second end, a first side, a second side opposite said first side, and an edge extending along a periphery of said skin contacting area, and a hand-held portion, wherein the hand-held portion is coated with a compressible material, when it is warm, to take the strain off the hand of the user.

In another embodiment, the compressible material hardens when it cools.

In another embodiment, the compressible material stays slightly compressible, without losing its shape, when it is cool.

In another embodiment, the present disclosure provides for a compressible material that is made from at least one polymer with a low melting temperature.

In another embodiment, the present disclosure provides for a compressible material is made from a mixture of at least two polymers with low melting temperatures.

In another embodiment, the present disclosure provides for a soft tissue mobilization device, wherein the edge extending along a periphery of said skin contacting member comprises at least one curve.

In another embodiment, the present disclosure provides for a soft tissue mobilization device, wherein the edge extending along a periphery of said skin contacting member is straight.

In another embodiment, the present disclosure provides for a soft tissue mobilization device, wherein the compressible material is mixture of at least two polymers that each have a low melting point.

In another embodiment, the present disclosure provides for a soft tissue mobilization device, wherein the hand-held portion is roughened before the compressible material is applied.

In another embodiment, the present disclosure provides for a soft tissue mobilization device, wherein the compressible material is custom molded to the shape of the user's hand on the hand-held portion.

In another embodiment, the present disclosure provides for a soft tissue mobilization device, wherein the compressible material has a soft feel after it has cooled and adhered to the hand-held portion.

In another embodiment, the present disclosure provides for a soft tissue device, wherein the compressible material does not react with massage oils, creams, or lotions.

In another embodiment, the present disclosures provides for a soft tissue mobilization device comprising a skin contacting member having a first side, a second side opposite said first side, a treatment edge extending along a periphery of said skin contacting member, and a hand-held portion comprising at least one ridge for gripping said soft tissue mobilization device, wherein the hand-held portion is coated with a compressible material to take the strain off the hand of the user.

In another embodiment, the present disclosure provides for a soft tissue mobilization device, wherein the at least one ridge is planar with surrounding portions of said first side.

In another embodiment, the present disclosure provides for a soft tissue mobilization device, wherein the at least one ridge is rounded.

In another embodiment, the present disclosure provides for a soft tissue mobilization device, wherein the hand-held portion is covered with a compressible material to provide great numbers thereof through use of manufacturing techniques.

In another embodiment, the present disclosure provides for a soft tissue mobilization device, wherein the compressible material is custom molded to the shape of the user's hand on the hand-held portion.

In another embodiment, the present disclosure provides for a soft tissue mobilization device, wherein the hand-held portion comprises at least two openings therethrough for the compressible material to enter after dipping the hand-held portion into the compressible material.

In another embodiment, the present disclosure provides for a soft tissue device, wherein the compressible material does not react with massage oils, creams, or lotions.

In another embodiment, the present disclosure provides for a method for coating the hand-held portion of the soft tissue mobilization device comprising warming at least two polymers with low melting temperatures separately to a temperature above their respective melting temperatures, placing the at least two liquid polymers with low melting temperatures in one container, mixing the at least two liquid polymers with low melting temperatures in the one container, dipping the hand-held portion into the container to coat the hand-held portion in a mixture of the at least two liquid polymers with low melting temperatures, extracting the hand-held portion from the container, cooling the hand-held portion with the mixture of the at least two polymers coated thereon to a temperature that will not burn an ungloved hand, wherein the mixture of the at least two polymers semi-solidifies into a compressible material which is custom molded by the user grabbing the material so that the compressible material molds to the exact shape and grasp of the user's hand.

In another embodiment, the present disclosure provides for a method wherein the compressible material is made from a mixture of at least two polymers from the group of polymers comprising thermoplastic, remodelable, and rubber.

In another embodiment, the present disclosure provides for a method wherein the compressible material does not adhere to the user's hand when grabbing the compressible material.

DESCRIPTION OF THE PREFERRED EMBODIMENTS

The following detailed embodiments presented herein are for illustrative purposes. That is, these detailed embodiments are intended to be exemplary of the present invention for the purposes of providing and aiding a person skilled in the pertinent art to readily understand how to make and use of the present invention.

Accordingly, the detailed discussion herein of one or more embodiments is not intended, nor is to be construed, to limit the metes and bounds of the patent protection afforded the present invention, in which the scope of patent protection is intended to be defined by the claims and equivalents thereof. Therefore, embodiments not specifically addressed herein, such as adaptations, variations, modifications, and equivalent arrangements, should be and are considered to be implicitly disclosed by the illustrative embodiments and claims described herein and therefore fall within the scope of the present invention.

Further, it should be understood that, although steps of various claimed methods may be shown and described as being in a sequence or temporal order, the steps of any such method are not limited to being carried out in any particular sequence or order, absent an indication otherwise. That is, the claimed method steps are considered capable of being carried out in any sequential combination or permutation order while still falling within the scope of the present invention.

Additionally, it is important to note that each term used herein refers to that which a person skilled in the relevant art would understand such term to mean based on the contextual use of such term herein. To the extent that the meaning of a term used herein, as understood by the person skilled in the relevant art based on the contextual use of such term, differs in any way from any particular dictionary definition of such term, it is intended that the meaning of the term as understood by the person skilled in the relevant art should prevail.

Furthermore, a person skilled in the art of reading claimed inventions should understand that "a" and "an" each generally denotes "at least one," but does not exclude a plurality unless the contextual use dictates otherwise. And that the term "or" denotes "at least one of the items," but does not exclude a plurality of items of the list.

Figure 1:
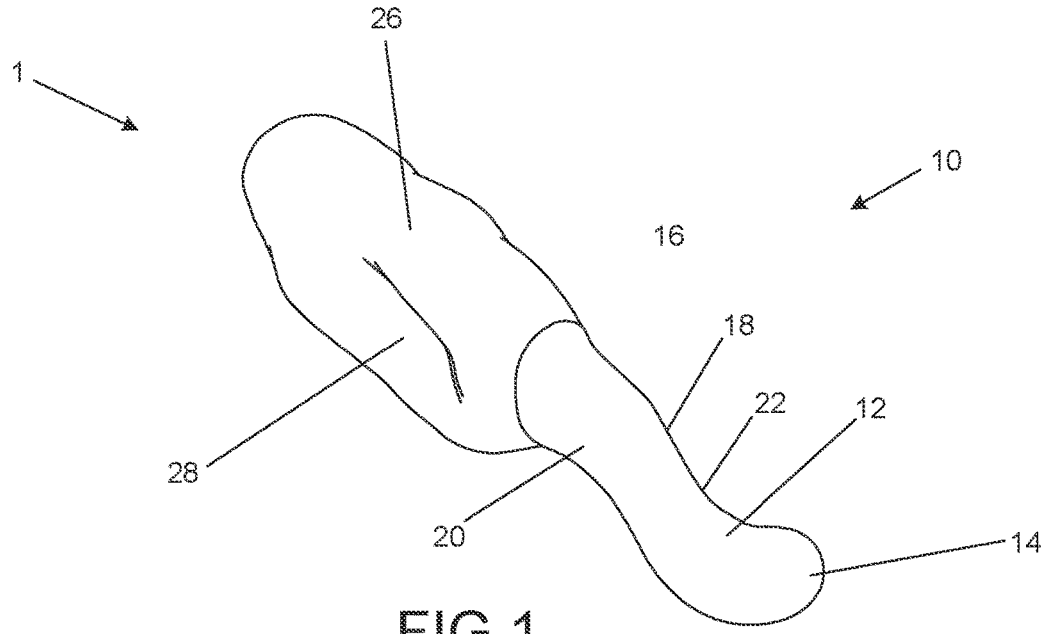
FIG. 1 illustrates a perspective view of an embodiment of the soft tissue mobilization device in accordance with the principles of the present disclosure.
Figure 2:
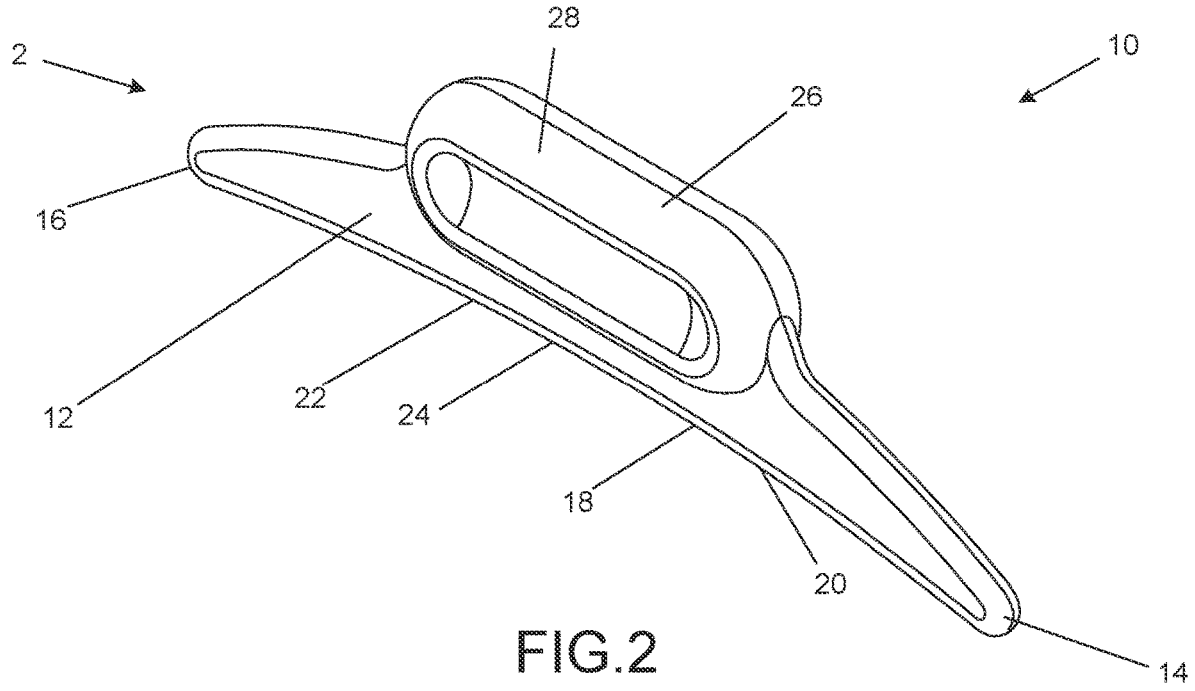
FIG. 2 illustrates a perspective view of an embodiment of the soft tissue mobilization device in accordance with the principles of the present disclosure.

Referring now to the drawings in greater detail there is illustrated in FIG. 1, a first configuration 1 of instrument assisted soft tissue mobilization device, commonly referred to as a scraping tool or soft tissue mobilization device 10, which can be made from a hard material, such as stainless steel, titanium, various plastics, stone, animal bone, or an animal's antler or horn. A second configuration 2 is illustrated in FIG. 2. FIG. 1 and FIG. 2 illustrate the skin contacting member 12 of the soft tissue mobilization device 10 can be shaped into an appropriate configuration such that it had curves that were biologically appropriate, meaning that the soft tissue mobilization device 10 could have curvature that would allow it to slide over a part of a human body and apply force against the soft tissue under the skin (not shown). The shape of the soft tissue mobilization device 10 could be customized for application to a specific area of the body. For example, the shape of a soft tissue mobilization device 10 used on the hands would have much smaller curvature and would be lighter and easier for the practitioner to hold (FIG. 1) in comparison to a larger soft tissue mobilization device 10 with a larger curve (FIG. 2) which would be necessary for working on a larger portion of the body, such as, for example, the calves, thighs, or lower back (not shown).

The soft tissue mobilization device 10 comprises a first end 14, a second end 16, a first side 18, a second side opposite said first side 20, and an edge extending along a periphery of said skin contacting member ("edge") 22. The edge 22 can comprise at least one curve 24, though it could comprise a plurality of curves (not shown). The at least one curve 24 can comprise a small or a large arch, depending on what body part the soft tissue mobilization device is for. The edge 22 can also be straight or slightly curved (FIG. 2).

Figure 3:
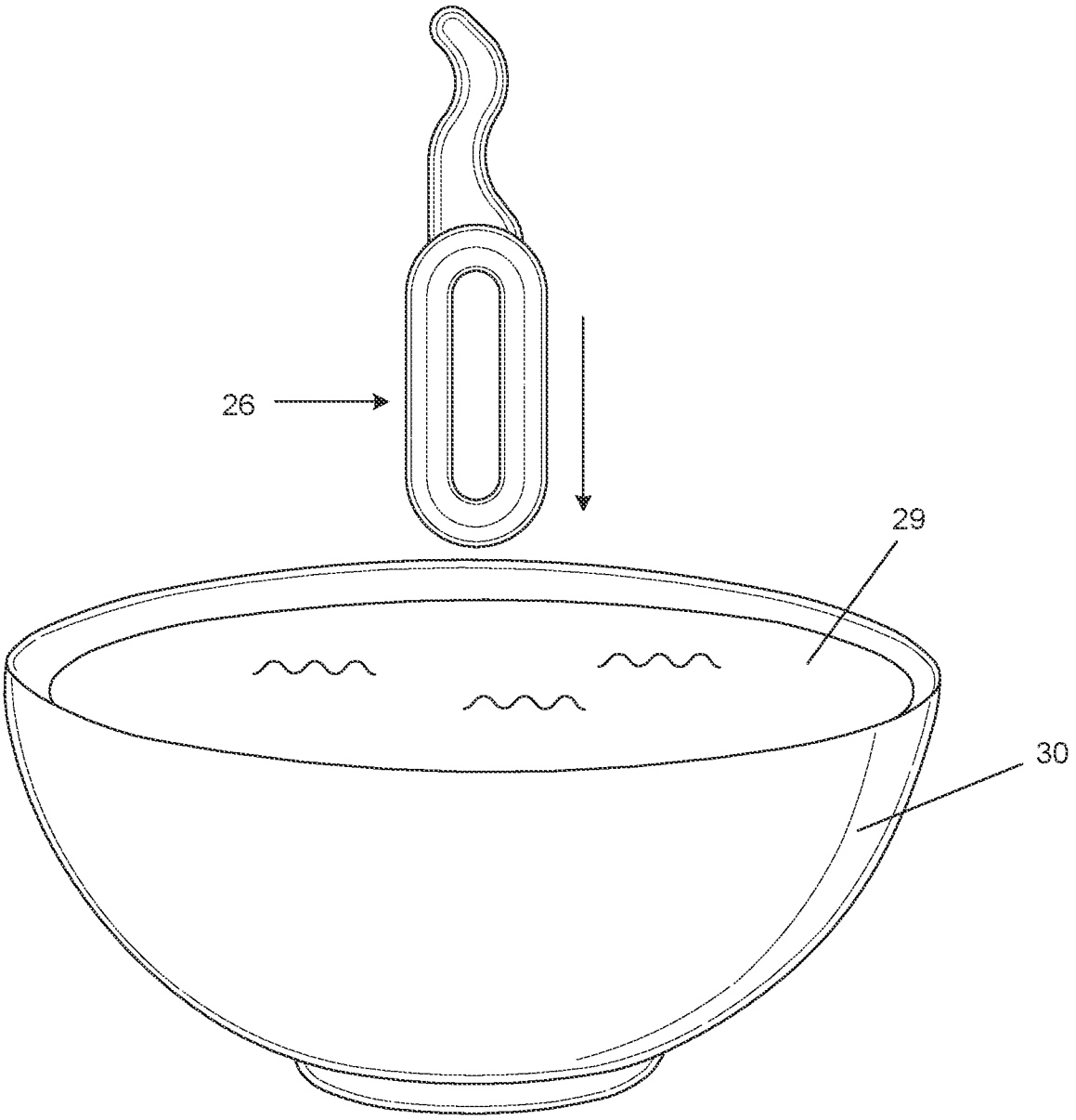
FIG. 3 illustrates a front view of an embodiment of the soft tissue mobilization device after said soft tissue mobilization device has been dipped into a mixture of at least two compounds, preferably polymers, that have a low melting temperature.

FIG. 3 illustrates the method of coating the hand-held portion 26. The hand-held portion 26 can be dipped into a compound, preferably a polymer with a low melting temperature. The compound can also be a mixture of at least two components, such as at least two polymers with low melting temperatures or at least one polymer with a low melting temperature and at least one dye. The polymers can be selected from a group comprising thermoplastic, remodelable, and rubber. The compound is placed into container 30, warmed to a temperature above its respective melting temperature, and mixed. The hand-held portion 26 of the soft tissue mobilization device 10 can be dipped into the warm compound inside the container 30 to allow the compound to bond to the hand-held portion 26. The hand-held portion 26 is then extracted from the container and allowed to cool to a temperature that will not burn an ungloved hand. The compound semi-solidifies as it cools into the compressible material 28 (not shown).

It could be preferable to create both a chemical bond between the materials, such as polymers, mixed to create the compressible material 28, as well as a mechanical bond between the compressible material 28 and the hand-held portion 26. For example, a stainless steel soft tissue mobilization device 10 would need to have a roughened surface created on the hand-held portion 26 to allow the compound, such as at least one polymer, to bond to the hand-held portion 26. The roughened surface could be created mechanically, for example, with sandpaper or a grinder, or roughened with an end mill, or laser, or possibly sandblasted in order to create more surface area for the compound to bond too. The increased surface area created by the roughening would allow for microbonding to occur between the hard material of the hand-held portion 26 and any suitable compound/compressible material bonded thereover.

Also a mechanical bond between the two components of the hand-held portion 26 could be preferable. It is envisioned in one embodiment that the hard material of the hand-held portion 26 would include multiple openings therein (not shown) to allow a mixture of at least two materials, such as polymers or a polymer and a dye, to flow therethrough during the coating process and create a significant mechanical interface between the two materials in the hand-held portion 26. In a preferred embodiment, the compressible material 28 is made from one low melting point polymer 29. In one embodiment, the compressible material 28 is made from a mixture of at least two low melting point polymers.

Also, it will be understood that using a low melting point polymer, the practitioner would be able to customize the handle directly to their hand, as an alternative to the method described above. By using a thermoplastic material to coat the hand-held portion 26, it would be possible to reheat and reshape as many times as is necessary to achieve a handle that is as comfortable as possible.

In the manufacturing process of over-molding a compressible material 28, such as an ergonomic polymer, onto the material of the hand-held portion 26, there are several ways that this could be achieved which would be understood by one skilled in the art.

Figure 4:
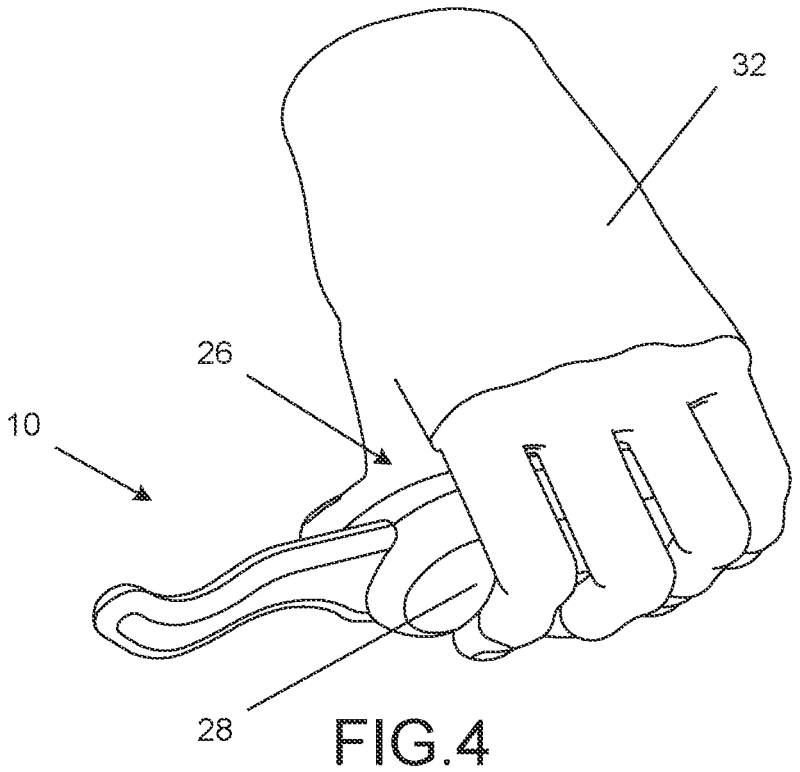
FIG. 4 illustrates a perspective view of custom molding the compressible material to the shape of the practitioner's or user's hands by grabbing the semi-solid cooled mixture of at the least two compounds that has turned into the compressible material.

Turning to FIG. 4, configuration 1 is shown and illustrates the custom molding of the compressible material to the shape of the practitioner's or user's hand(s) 32. The practitioner or user grabs the semi-solid cooled mixture of at least two polymers that has turned into the compressible material 28 with his or her hand(s) 23 to mold it to the shape of the practitioner's or user's hand(s) 32. The compressible material 28 does not adhere to the user's hand(s) 32 when it is grabbed by the practitioner or user.

The compressible material 28 bonded to the hand-held portion 26 provides ergonomic support to the practitioner's or user's hand and decreases stress and/or strain on the hand(s) 32 when the practitioner or user uses the soft tissue mobilization device 10.

Figure 5:
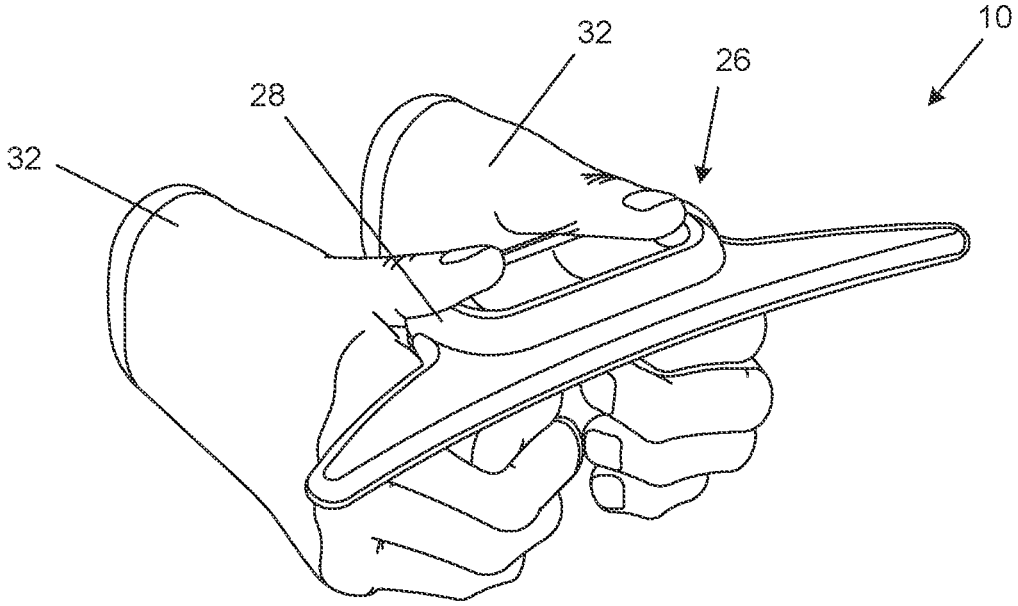
FIG. 5 illustrates a perspective view of custom molding the compressible material to the shape of the practitioner's or user's hands by grabbing the semi-solid cooled mixture of at the least two compounds that has turned into the compressible material.

Turning to FIG. 5, configuration 2 is shown and illustrates the custom molding of the compressible material to the shape of the practitioner's or user's hands using the same method as described for FIG. 4.

In another configuration, the soft tissue mobilization device 10 or the skin contacting member 12 thereof would be similar, if not identical, to the ones described above. A practitioner could be provided with the core material body of the soft tissue mobilization device 10 and also receive two containers, each containing one part of a two-part mixture. The containers may contain rubberlike materials. The two parts of the rubberlike material would be mixed by the practitioner in an appropriate ratio which would provide a rubber or putty like material with a specific working time. This rubber material would then be hand molded by the practitioner over the hand-held portion 26 of the soft tissue mobilization device 10 to provide the most precise customized molded fit to the hand. The hand-held portion 26 could be roughened and/or possibly comprise holes, openings, grooves or undercuts in order to allow the mixture of the two parts to enter the hand-held portion 26 and easily bind the putty like material to the hand-held portion 26. The two part rubber or putty like material on the soft tissue mobilization device 10 would be allowed to harden for a specific amount of time, producing a customized ergonomic grip for the hand-held portion 26. An advantage to using a two-part rubber material is that the material would be soft and more pliable in the hand. This soft pliability of material would allow for better control and also the grip placed on the rubber-like material and would require less effort or forced use the tool on a patient.

In another embodiment, the hand-held portion 26 of the soft tissue mobilization device 10 could comprise an over molded rubber or plastic pre-designed ergonomic grip. This would be achieved by using either a compression or injection mold and injecting thermoplastic or a setting type rubber around and possibly through the hand-held portion 26 of the soft tissue mobilization device 10. The advantage of this embodiment is that it would allow for high quantity production of a generically ergonomic handled soft tissue mobilization devices 10 that would be comfortable enough for use by a majority of practitioners.

In another embodiment, an overmolded soft material such as a gel-like or squishy material would be molded over and possibly through the hard hand-held portion 26. The gel-like or squishy over molded material would provide a soft hand-held portion 26, and would conform to the user's hand(s) 32 as he or she was using it. One advantage of this embodiment is that the user does not need to choose a permanent design for the hand-held portion 26 and it would conform as needed to the user's varying demands.

While certain exemplary embodiments of the device have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soft tissue mobilization device comprising:

a skin contacting body comprising a treatment edge extending along a periphery of the skin contacting body; wherein an entirety of said treatment edge is configured to mobilize soft tissue under a skin of a user or a patient, the skin contacting body configured to slide over the user's or patient's skin;

a hand-held portion comprising at least one ridge for gripping said soft tissue mobilization device, wherein the hand-held portion is coated with a compressible material to take a strain off a hand of the user, the compressible material is configured to be custom molded on the hand-held portion to the user's hand, the compressible material is a compound comprising a mixture of one or more low melting point polymers, the compressible material is capable of being custom molded to the user's hand when the compressible material is exposed to heat, thereby, allowing the compressible material to be reheated and reshaped as many times as necessary when in use, the hand-held portion comprising a rough surface under the compressible material, the rough surface is configured to increase a surface area of the hand-held portion such that the compressible material's adhesion to the rough surface is increased, and the compressible material does not react with massage oils, creams, or lotions; and the soft tissue mobilization device being made from stainless steel, titanium, bone, or stone, wherein the treatment edge is part of a single edge that continuously extend from a first end of the hand-held portion to a second end of the hand-held portion, the skin contacting body comprises an exposed upper surface defined by the hand-held portion and the single edge, and an exposed bottom surface opposite of the exposed upper surface, wherein the exposed bottom surface is defined by the hand-held portion and the single edge, wherein thicknesses between the entire exposed upper surface and the entire exposed bottom surface are formed in a manner that allowed the entire skin contacting body to be substantially flat.

2. The soft tissue mobilization device of claim 1, wherein the at least one ridge is rounded.

* * * * *